US011425929B2

(12) United States Patent
Thoede, Jr.

(10) Patent No.: US 11,425,929 B2
(45) Date of Patent: Aug. 30, 2022

(54) SMOKING APPARATUS AND METHOD OF USE

(71) Applicant: Aubrey Ray Thoede, Jr., Katy, TX (US)

(72) Inventor: Aubrey Ray Thoede, Jr., Katy, TX (US)

( * ) Notice: Subject to any disclaimer, the term of this patent is extended or adjusted under 35 U.S.C. 154(b) by 561 days.

(21) Appl. No.: 15/218,531

(22) Filed: Jul. 25, 2016

(65) Prior Publication Data

US 2018/0020718 A1 Jan. 25, 2018

(51) Int. Cl.

| | |
|---|---|
| ***A24F 1/02*** | (2006.01) |
| ***B65D 23/12*** | (2006.01) |
| ***A24F 7/00*** | (2006.01) |

(52) U.S. Cl.

CPC ..... *A24F 1/02* (2013.01); *A24F 7/00* (2013.01); *B65D 23/12* (2013.01)

(58) Field of Classification Search

None

See application file for complete search history.

(56) References Cited

U.S. PATENT DOCUMENTS

| | | | | |
|---|---|---|---|---|
| 3,057,362 | A | 10/1962 | Flint | |
| 3,583,407 | A | 6/1971 | Pokras | |
| 3,910,287 | A | 10/1975 | Walton | |
| 4,116,204 | A | 9/1978 | Kline | |
| 4,253,475 | A | 3/1981 | Schreiber et al. | |
| 4,351,316 | A | 9/1982 | Kroll | |
| 4,648,410 | A | 3/1987 | Seroussi | |
| 5,140,711 | A | 8/1992 | Johnson | |
| 6,513,524 | B1 | 2/2003 | Storz | |
| 7,475,684 | B2 | 1/2009 | Balch et al. | |
| 7,611,072 | B2 | 11/2009 | Peters et al. | |
| 8,469,036 | B2 | 6/2013 | Williams et al. | |
| 8,534,296 | B2 | 9/2013 | Groff | |
| 8,973,585 | B2 | 3/2015 | Goldstein | |
| 2006/0217255 | A1 | 9/2006 | Collier | |
| 2009/0084391 | A1* | 4/2009 | Krupp | A24F 1/30 131/173 |
| 2012/0187071 | A1 | 7/2012 | Martinovic et al. | |
| 2013/0146070 | A1 | 6/2013 | Ross | |
| 2014/0255014 | A1* | 9/2014 | Bishara | F24H 3/002 392/488 |
| 2014/0305447 | A1 | 10/2014 | Saco | |
| 2015/0075544 | A1* | 3/2015 | Portz | A24D 1/14 131/328 |

FOREIGN PATENT DOCUMENTS

| | | | |
|---|---|---|---|
| EP | 0878242 | 10/2004 | |
| EP | 2848136 A1 * | 3/2015 | A24F 1/30 |

* cited by examiner

*Primary Examiner* — Phu H Nguyen

(74) *Attorney, Agent, or Firm* — Stephens | Domnitz | Meineke PLLC; Ira P. Domnitz; Matthew C. Juren

(57) ABSTRACT

A smoking adaptor with a body, which has a materials receptacle and a hollow column leading from the top part of the smoking adaptor through the lower section of the smoking adaptor such that materials placed in the receptacle can be ignited and smoke created by the combustion flows though the hollow column. The smoking adaptor can be in the form of a solid piece or multiple pieces that can combine with each other.

13 Claims, 3 Drawing Sheets

SMOKING APPARATUS AND METHOD OF USE

CROSS-REFERENCE TO RELATED APPLICATIONS

Not applicable

STATEMENT REGARDING FEDERALLY SPONSORED RESEARCH

Not applicable.

BACKGROUND

Pipes and hookahs are common devices for smoking substances such as tobacco. Smoking pipes typically include a receptacle for receiving the substance to be smoked (e.g., tobacco) and a pipe or chamber coupled to the receptacle for conducting smoke or vapor once the substance has been ignited. The section of the chamber typically includes an aperture from which the smoke may be inhaled by the user. In hookahs this chamber may be filled with a liquid to condition the smoke, such as by filtering impurities and cooling it, prior to inhalation by the user. Smoking devices, including pipes, hookahs, and other devices, may be configured for optimum flavor, filtration and conditioning of the smoke prior to inhalation, aesthetics, and convenience or portability. The present inventive device offers benefits over prior existing technology.

The present invention differs from U.S. Pat. No. 358,407 in that the present invention cannot be directly smoked from by a user, it requires additional tubing. The present invention requires a different device such as a water bottle so that user may throw away unwanted residue collected from smoke while the present device is in operation. The present device also offers the capability of portably converting almost any bottle into a smoking device.

The present invention differs from U.S. Pat. No. 4,648,410 in that the smoke drawn never passes through water in the invention of U.S. Pat. No. 4,648,410, unlike some embodiments of the present invention. The present invention can also universally fit on any water bottle. The present device also offers the capability of portably converting almost any bottle into a smoking device.

The present invention differs from US Pat. Application 2012/0187071 in that the present invention is designed for tobacco, or other solids use, and the invention of 2012/0187071 is used for liquid containment, and ensuring that the user has a sterile passage way to drink the liquid. The present device also offers the capability of portably converting almost any bottle into a smoking device.

The present invention differs from U.S. Pat. No. 5,140,711 which is designed to attach to any bottle so that the user may spit excess tobacco "dip" while my product requires you to ignite tobacco materials. The present device also offers the capability of portably converting almost any bottle into a smoking device.

The present invention differs from 2013/0146070 in that this product can only fit certain threaded plastic bottles while the present invention is universal. 2013/0146070 also uses water to pull smoke into the container while the present invention is powered by the user's lungs. The present invention can also add holes into a container for better air flow.

The present invention differs from Pat. Application 2014/0305447 in that the present invention uses dry combustible materials, while the device of Pat. Application 2014/0305447 uses shisha which is a gelled tobacco product that can only be burned with a coal placed above the gelled tobacco. The present device also offers the capability of portably converting almost any bottle into a smoking device.

The present invention differs from U.S. Pat. No. 8,973,585 because this product is one solid object that contains its own filtering mechanism and smoke passage way whereas the present invention has interchangeable parts and uses a disposable bottle for the smoke to pass through. The present device also offers the capability of portably converting almost any bottle into a smoking device.

The present invention differs from U.S. Pat. No. 7,475,684 because the invention of U.S. Pat. No. 7,475,684 uses a battery and heats the tobacco leaves or herbs so that the user may have a cleaner/less harsh way of causing the smoke to enter the body. While the present invention contains no batteries and uses a combustible fire to ignite the tobacco substances. The present device also offers the capability of portably converting almost any bottle into a smoking device.

The present invention differs from U.S. Pat. No. 4,116,204 because the invention of U.S. Pat. No. 4,116,204 is a collapsible product that contains its own smoke passage way and a built in water filtering device whereas the present invention does not need to filter through water. The present invention may also use a plastic bottle so that the smoke may pass through. The present device also offers the capability of portably converting almost any bottle into a smoking device.

The present invention differs from U.S. Pat. No. 4,253,475 because the invention of U.S. Pat. No. 4,253,475 uses a series of tools and mechanisms in an attempt to filter the smoke through multiple devices to make the inhalation smoother and easier to inhale through your lungs. The present invention offers a way to make smoke passable, through a bottle, to the user's lungs. The present device also offers the capability of portably converting almost any bottle into a smoking device.

SUMMARY

The present inventive device generally comprises a smoking adaptor with a body, which has a materials receptacle and a hollow column leading from the top part of the smoking adaptor through the lower section of the smoking adaptor such that materials placed in the receptacle can be ignited/combusted and the smoke created by the combustion flows though the hollow column. The smoking adaptor can be in the form of a solid piece or multiple pieces that can combine with each other.

In some embodiments, the smoking adapter has a central, or longitudinal axis, and includes a generally conical body having a first terminal section that receives material (e.g., tobacco, etc.) to be smoked, and a second terminal section that forms a point. Point at second section may be used to pierce the surface of a bottle to form a smoking device assembly. In one embodiment the conical body may be formed from a metal, such as stainless steel, or a plastic.

In some embodiments, the smoking adapter also includes an annular, conical, or frustoconical seal disposed on an outer generally cylindrical surface of the body of the smoking adaptor. In one embodiment, frustoconical seal may be formed from an elastomer. The seal may seal against an opening of a bottle for forming a smoking device assembly. The first section may form a circular face from which a cylindrical receptacle having a centrally disposed bore extending there through in which material to be smoked may be received or disposed. While in this embodiment the body is generally conical, in other embodiments smoking adapter may include a body of varying shapes, including, for instance, a generally cylindrical body. Also in some embodiments there is a central annulus which runs along the longitudinal access and through second end. In some embodiments the junction and egress ports are located in second section and allow for a duct egress out of central annulus. In many embodiments, the smoking adaptor can be molded of one solid material except for seal which can be molded of a separate elastomer material.

In several embodiments of the smoking adapter the present invention is in a single molded unit or as modular units that can be combined to form the present invention. In in one embodiment smoking adapter has a central or longitudinal axis and includes a generally conical body having a first terminal section that receives material (e.g., tobacco, etc.) to be smoked, and a second terminal section that forms a point. Point at second section may be used to pierce the surface of a bottle to form a smoking device assembly. In an embodiment, conical body may be formed from a metal, such as stainless steel, or a plastic.

In some embodiments, the three main sections of one embodiment of the present invention are the upper section, middle section and lower sections. The upper section is preferably comprised with a threaded male mating member which is preferably designed to engage threaded female member located on the top of middle section. Likewise located on the bottom half of middle section is female member which is preferably designed to engage male threading member located on the top of lower section. Although the threading member engagement disclosed is exemplary of one embodiment of the present invention, one of ordinary skill in the art could see how many variations of threading members for achieve a similar result as found in the present invention. Other attachment methods and arrangements such as clasps, pins, and non-threaded members could be utilized to hold upper section, middle section and lower section together when the present inventive device is assembled.

In several embodiments, the present invention is assembled by screwing male member into female member, then screwing male member into female adaptor. It is envisioned though, that the screwing steps can be done in essentially any order. In several embodiment the seal can be placed over middle section in a manner known in the art so to mechanically engage middle section, yet be removable with the application of force. In several embodiments of the present invention, the middle section and seal are tapered such that the diameters of each are larger nearest female mating member and smallest near female mating member.

In some embodiments of the present invention there is an alternate embodiment of the middle section. In this embodiment, middle section further comprises a secondary shaft which runs from the top of the middle section through to the bottom of middle section.

In some embodiments of the present invention there is an alternative embodiment for the upper section. In this embodiment upper section is modified to include gas tube which is preferably engineered to fit engagingly over an orifice which runs through circular face. Also included is a tertiary shaft which in several embodiments runs from the exterior side surface of circular face through to the central annulus. In several embodiments of the present invention there is also a funnel adaption designed to mechanically interface with the bore forming the bottom and extension which attaches directly to the top face of circular face. In operation materials for combustion can be placed into funnel and ignited.

In several embodiments, the lower section of the smoking adaptor is used to penetrate the lower section of a bottle. The bottle is preferably designed of a plastic, resin or other material that will not shatter if its outer surface is penetrated or perforated. The bottle can be of any size and will preferable contain a top cap end. Top cap section maybe threaded, smooth or of other shapes such that materials can be poured into and/or away from bottle. In some embodiments the lower section can be heated to increase the efficacy of perforation.

In one embodiment of the present invention smoke adaptor materials can be ignited or combusted. Once ignited the gas formed from materials flows into bottle and can inhaled by section user through a bottle orifice. Furthermore the smoking adaptor may be fittingly inserted into a top cap section such that seal forms a gas tight seal between smoke adaptor and cap section therein not allowing gas to escape.

Some embodiments of the present invention may utilize a fluid. In many instances the fluid may be water, or some other noncombustible and nontoxic liquid. In one embodiment of the present invention smoke adaptor has materials that are ignited. Once ignited the gas formed from materials flows into a bottle and through the fluid and can inhaled by section user through a tube. In some embodiments, the smoke adaptor is fittingly inserted into a top cap section such that the seal forms a gas tight seal between the smoke adaptor and cap section therein not allowing gas to escape. In some embodiments of the present invention a secondary shaft lines up with an orifice when the smoking adaptor is assembled such that a gas can flow through secondary shaft egress tube, through shaft through orifice and into tube and into section user when the user inhales through the tube.

In some embodiments, the present invention is a smoking adapter for smoking a substance, comprising: a body for receiving a seal disposed on an outer surface of the body; said body further comprising a top section, middle section and lower end; said top section further comprising a receptacle with an orifice for holding combustible materials; a passage extending through said receptacle with an orifice for holding combustible materials said body further comprising a top section, middle section and lower end; said lower section further comprising plurality of radial ports disposed in said lower end; wherein said seal is configured to seal against a neck opening in a bottle. In some embodiments the lower section further comprises a solid point for piercing a surface of a solid material. In some embodiments the top section, middle section and lower section comprise three separate modules which can mechanically engage each other in the arrangement such that the top section engages the middle section and the middle section engages the lower section. In some embodiments the top section, middle section and lower section are one premolded unit. In some embodiments the top section further comprises a tube attached and in communication with a second passage running though said top section adjacent to said passage extending through said receptacle with orifice for holding combustible materials. In some embodiments, the middle section comprises a third passage running though said middle section and having an ingress port from the side of said middle section, such that said second passage and said third passage are aligned during operation to allow for passage of gas from third passage through second passage. In some embodiments the top section further comprises a fourth passage extending through the top section and substantially perpendicular and connected to said first passage. In some embodiments the receptacle with orifice for holding combustible materials is funnel shaped. In some embodiments, the bottle is perforated by said solid point for piercing a surface of a solid material. In some embodiments the bottle is filled with a nontoxic and noncombustible fluid.

In some embodiments the present invention is a method for using a smoking adapter for smoking a substance, with the steps of: obtaining combustible material; obtaining a smoking adaptor comprising; a body for receiving a seal disposed on an outer surface of the body; said body further comprising a top, middle and lower end; said top section further comprising a receptacle with an orifice for holding said combustible materials; a passage extending through said receptacle with orifice for holding said combustible materials, middle and lower section of the body to a plurality of radial ports disposed in said lower end; wherein said seal is configured to seal against an opening in a bottle; placing said combustible materials into said receptacle with orifice for holding said combustible materials; placing said smoking adaptor into the neck of a bottle with a hole in the bottom of said bottle; and igniting said combustible materials. In some embodiments the present invention has the additional step of perforating said bottle with said lower section of said body therein creating a hole. In some embodiments the present invention the additional step of placing said bottle with a hole to a user's orifice such that said hole is aligned to allow a user to inhale the gas caused by the ignition of said combustible material. In some embodiments the present invention has the additional step of filling said bottle such that the fluid line is above said radial ports disposed in said lower end.

BRIEF DESCRIPTION OF THE DRAWINGS

For a more complete understanding of the present disclosure, and the advantages thereof, reference is now made to the following descriptions to be taken in conjunction with the accompanying drawings describing specific embodiments of the disclosure, wherein.

DETAILED DESCRIPTION

Figure 1:
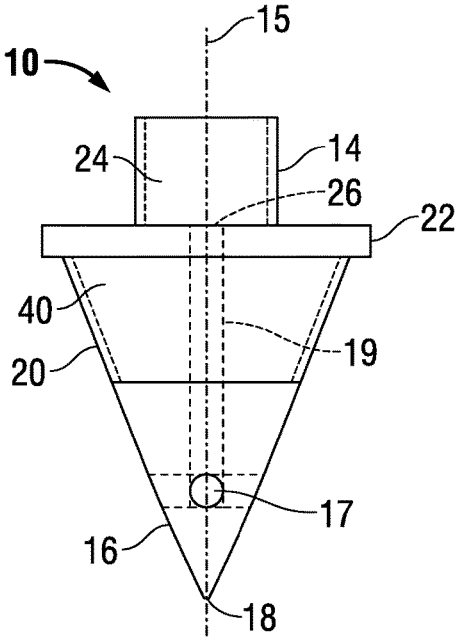
FIG. 1 is a perspective view of an embodiment of a smoking adapter as a single premolded unit.

One or more illustrative embodiments incorporating the invention disclosed herein are presented below. Applicant has created a revolutionary and novel smoking adaptor and method of use.

In the following description, certain details are set forth such as specific quantities, sizes, etc. so as to provide a thorough understanding of the present embodiments disclosed herein. However, it will be evident to those of ordinary skill in the art that the present disclosure may be practiced without such specific details. In many cases, details concerning such considerations and the like have been omitted inasmuch as such details are not necessary to obtain a complete understanding of the present disclosure and are within the skills of persons of ordinary skill in the relevant art.

Referring to the drawings in general, it will be understood that the illustrations are for the purpose of describing particular embodiments of the disclosure and are not intended to be limiting thereto. Drawings are not necessarily to scale and arrangements of specific units in the drawings can vary.

While most of the terms used herein will be recognizable to those of ordinary skill in the art, it should be understood, however, that when not explicitly defined, terms should be interpreted as adopting a meaning presently accepted by those of ordinary skill in the art. In cases where the construction of a term would render it meaningless or essentially meaningless, the definition should be taken from Webster's Dictionary, 11th Edition, 2008. Definitions and/or interpretations should not be incorporated from other patent applications, patents, or publications, related or not, unless specifically stated in this specification or if the incorporation is necessary for maintaining validity. Specifically defined terms include: "Frustoconical" as defined herein includes, but is not limited to "substantially of the shape of a frustum (part of a solid cone or pyramid formed by cutting off the top by a plane parallel to the base) of a cone". "Bottle" as defined herein includes "any enclosure designed to contain a small solids, fluid or a gas." "Ignite", "combust" or "light" as defined herein includes "the application of sufficient heat as to cause a material to combust."

Certain terms are used in the following description and claims to refer to particular system components. As one skilled in the art will appreciate, different persons may refer to a component by different names. This document does not intend to distinguish between components that differ in name but not function. The drawing figures are not necessarily to scale. Certain features of the invention may be shown exaggerated in scale or in somewhat schematic form, and some details of conventional elements may not be shown, all in the interest of clarity and conciseness.

FIG. 1 illustrates an embodiment of a smoking adapter 10 in accordance with principles disclosed herein. In this embodiment, smoking adapter 10 has a central or longitudinal axis 15 and includes a generally conical body having a first terminalsection14 that receives material (e.g., tobacco, etc.) to be smoked, and a second terminalsection16 that forms a point 18. Point 18 at secondsection16 may be used to pierce the surface of a bottle to form a smoking device assembly. In an embodiment, conical body may be formed from a metal, such as stainless steel, or a plastic. In many embodiments smoking adaptor 10 is constructed to withstand temperatures sufficient to combust plan, or other organic materials.

Smoking adapter 10 may also include an annular, conical, or frustoconical seal 40 disposed on an outer generally cylindrical surface 20 of the body of the smoking adaptor. In an embodiment, frustoconical seal 40 may be formed from an elastomer. As will be discussed further herein, seal 40 may seal against an opening of a bottle for forming a smoking device assembly 100 (See FIG. 6). In many embodiments seal 40 is removable or replaceable. In some embodiments, seal 40 may have external ridges or grooves for assisting in forming a gas tight seal.

First end, or top section 14 may form a circular face 22 from which a cylindrical receptacle 24 having a centrally disposed bore 26 extending there through in which material to be combusted, or lit, may be received or disposed. While in this embodiment body is shown as being generally conical, in other embodiments smoking adapter 10 may include a body of varying shapes, including, for instance, a generally cylindrical body, funnel, or cuboid shape. Also illustrated is the central annulus 19 which runs along the longitudinal access 15 and through second section 16. Junction and egress ports 17 are preferably located in lowersection16 and allow for a duct egress out of central annulus 19. In many embodiments, the smoking adaptor 10 can be molded of one solid material except for seal 40 which can be molded of a separate elastomer material. In many embodiments junctions and egress ports 17 may be located in other areas of the middle section 140.

Figure 2:
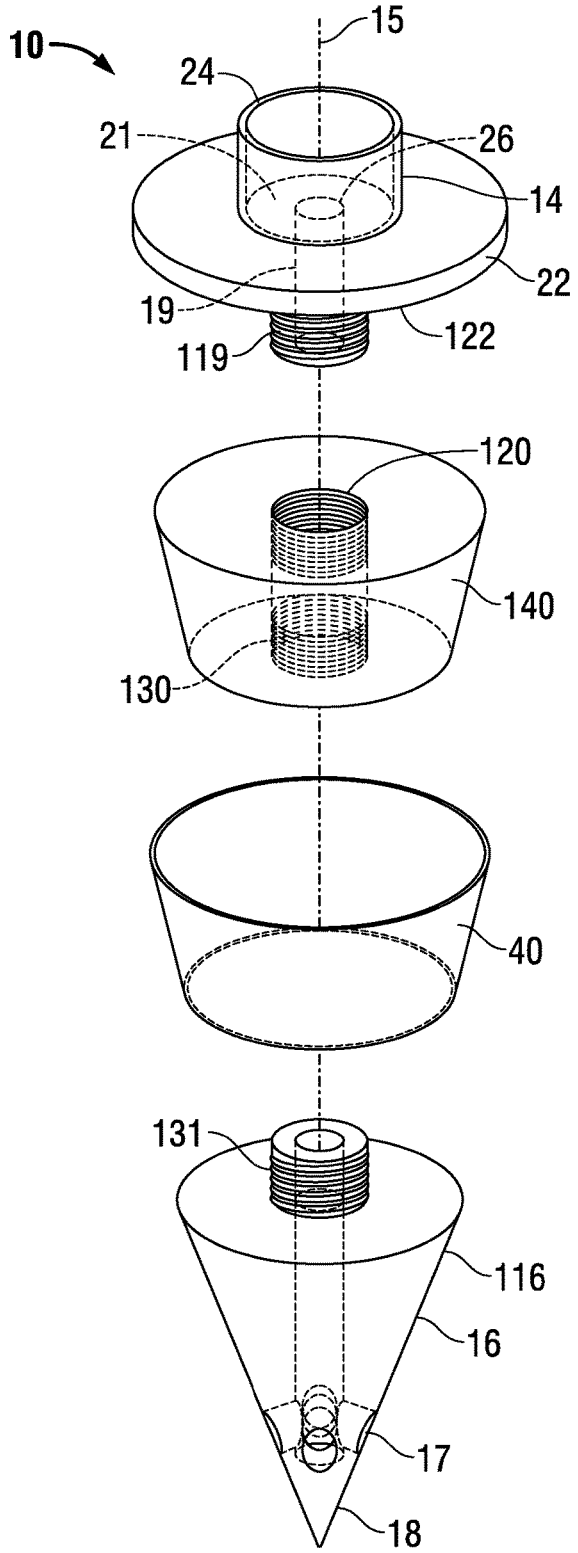
FIG. 2 is an exploded view illustrating internal features of one embodiment of the smoking adapter which the smoking adaptor is comprised of three modules.

FIG. 2 illustrates another embodiment of a smoking adapter 10 for forming a smoking device assembly in accordance with principles disclosed herein in exploded view. FIG. 2 also differs from FIG. 1, in that FIG. 1 illustrates one embodiment of the present invention in a single molded unit and FIG. 2 illustrates a potential embodiments of the present invention as modular units, or sections, which can be combined to form the present invention. In the embodiment of FIG. 2, smoking adapter 10 has a central or longitudinal axis 15 and includes a generally conical body having a first terminalsection14 that receives material (e.g., tobacco, etc.) to be smoked, and a second terminalsection16 that forms a point 18. Point 18 at secondsection16 may be used to pierce the surface of a bottle to form a smoking device assembly. In an embodiment, conical body may be formed from a metal, such as stainless steel, or a plastic. In many embodiments smoking adaptor 10 is constructed to withstand temperatures sufficient to combust plant, or other organic materials.

In some embodiments, smoking adapter 10 also includes an annular, conical, or frustoconical seal 40 disposed on an outer generally cylindrical surface 20 of the body of the smoking adaptor. In one embodiment, frustoconical seal 40 may be formed from an elastomer. As will be discussed further herein, seal 40 may seal against an opening of a bottle for forming a smoking device assembly 100 (See FIG. 6). First section 14 may form a circular face 22 from which a cylindrical receptacle 24 having a centrally disposed bore 26 extending there through in which material to be smoked may be received or disposed. While in this embodiment body is shown as being generally conical, in other embodiments smoking adapter 10 may include a body of varying shapes, including, for instance, a generally cylindrical body, ovoid or cuboid shape. Also illustrated is the central annulus 19 which runs along the longitudinal access 15 and through second section 16. Junction and egress ports 17 are located in second section 16 and allow for a duct egress out of central annulus 19.

Further illustrated in FIG. 2, are three main sections of one embodiment of the present invention upper section 122, middle section 140 and lower section 116. As illustrated upper section 122 is preferable comprised with a threaded male mating member 119 which is preferably designed to engage threaded female member 120 located on the top of middle section 140. Likewise located on the bottom half of middle section 140 is female member 130 which is preferably designed to engage male threading member 131 located on the top of lower section 116. Although the threading member engagement disclosed is exemplary of one embodiment of the present invention, one of ordinary skill in the art could see how many variations of threading members for achieve a similar result as found in the present invention. Other attachment methods and arrangements such as clasps, pins, and non-threaded members could be utilized to hold upper section 122, middle section 140 and lower section 116 together when the present inventive device is assembled. In several embodiments, lower section 116 can be heated to a sufficient temperature to allow for ease of perforation of bottle 300.

In several embodiments, the present invention is assembled by screwing male member 119 into female member 120, then screwing male member 131 into female adaptor 130. It is envisioned though, that the screwing steps can be done in essentially any order. Other methods of mechanically coupling modular units such as clasps, snaps, and locking joints would be known in the art. In several embodiment, seal 40 can be placed over middle section 140 in a manner known in the art so to mechanically engage middle section 140, yet be removable with the application of force. In several embodiments of the present invention, middle section 140 and seal 40 are tapered such that the diameters of each are larger nearest female mating member 120 and smallest near female mating member 130.

Figure 3:
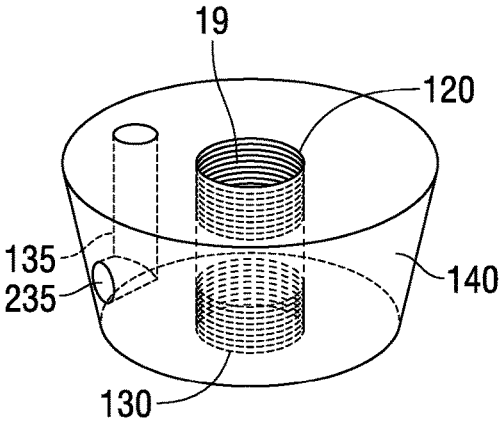
FIG. 3 is a partial cross section view of one embodiment of the middle section of the smoking adapter.

FIG. 3 illustrates an alternated embodiment of the present invention specifically an alternate embodiment of middle section 140. As illustrated the body of middle section 140 further comprises a secondary shaft or passage 135 which runs from the top of the middle section 140 through to the bottom of middle section 140. Secondary passage 135 is preferably designed to allow gas to enter/exit the passage through egress/ingress port 235.

Figure 4:
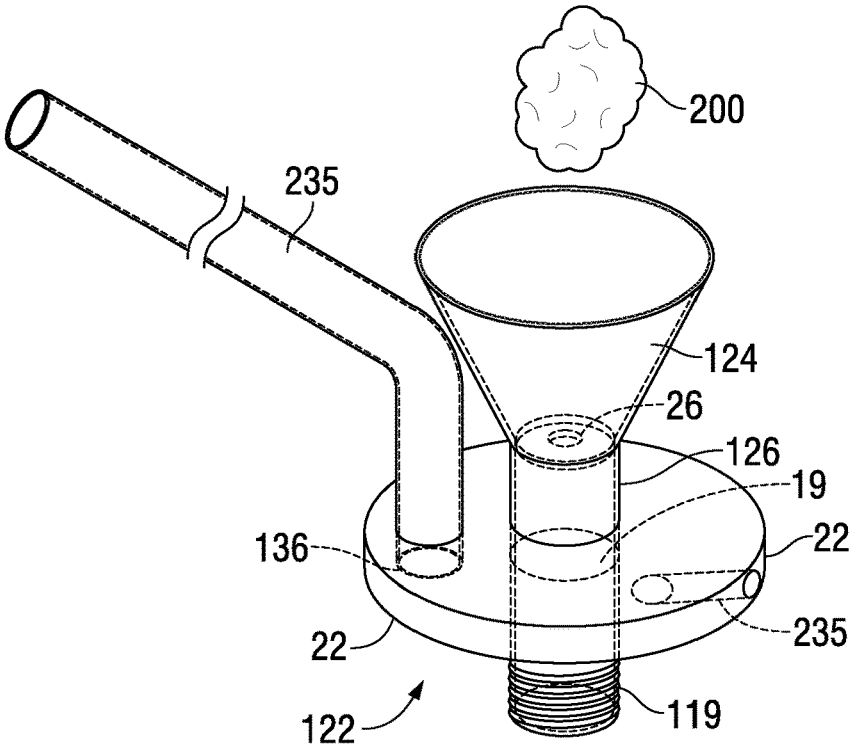
FIG. 4 is partial cross section view of the top section of one embodiment of the smoking adapter.

FIG. 4 illustrates an alternate embodiment of the upper section 122. In this embodiment upper section 122 is modified to include gas tube 235 which is preferably engineered to fit engagingly over orifice 136 which runs through circular face 22. Gas tube 235 may be composed of plastic, rubber or even glass. Also shown is side tertiary shaft, or passage 235 which in several embodiments runs from the exterior side surface of circular face 22 through to central annulus 19. The embodiment of FIG. 4 also has a funnel adaption 124 designed to mechanically interface with bore 26 forming the bottom and extension 126 which attaches direction to the top face of circular face 22. In operation materials 200 for combustion can be placed into funnel 124 and ignited.

Figure 5:
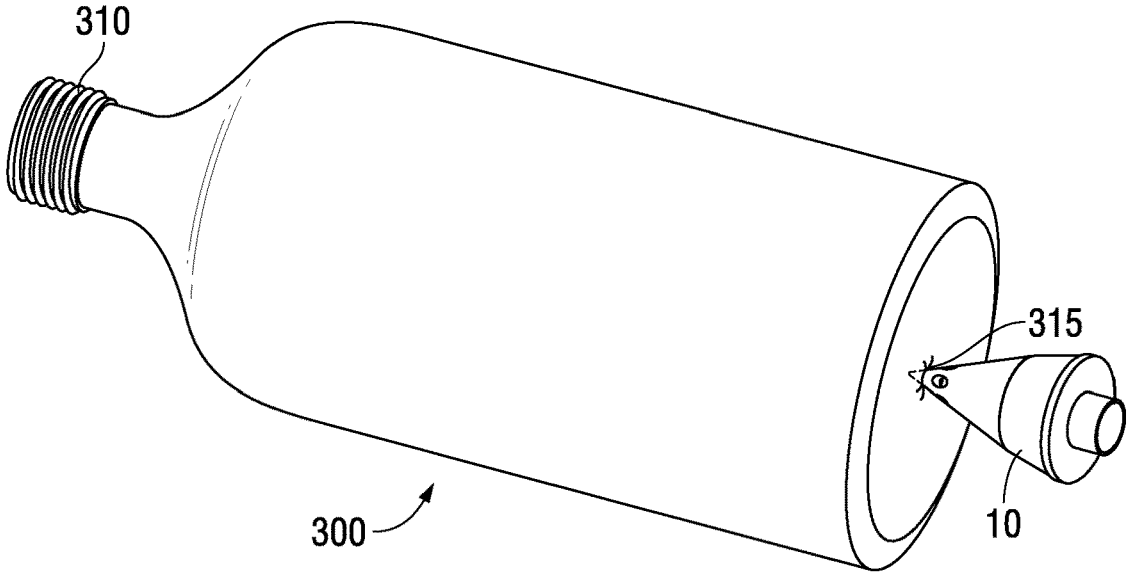
FIG. 5 is side view of one embodiment of the smoking adapter as it is penetrating a bottle.

FIG. 5 illustrates one embodiment of the present invention in which the smoking adaptor 10 is used to penetrate the lower section of a bottle 300. Bottle 300 is preferably designed of a plastic, resin or other material that will not shatter if its outer surface is penetrated or perforated. Bottle 300 can be of any size and will preferable contain a top capsection310. Top capsection310 maybe threaded, smooth or of other shapes such that materials can be poured into and/or away from bottle 300. The perforation hole or orifice 315 is preferably designed of a size to allow for the intake of a gas with particulates 250 when materials 200 are combusted.

Figure 6:
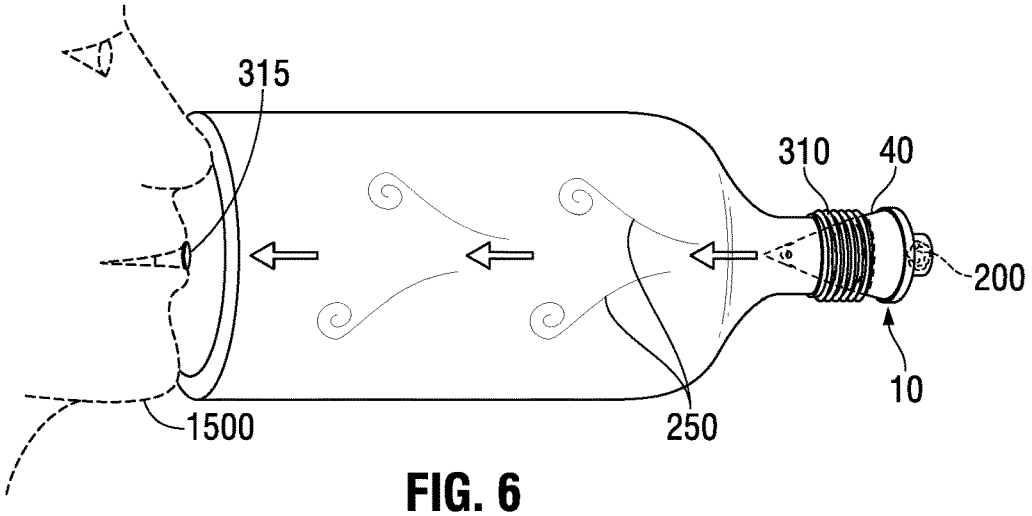
FIG. 6 is side view of a user inhaling materials from a penetrated bottle in on embodiment of the smoking adapter.

FIG. 6 illustrates one embodiment of the present invention smoke adaptor 10 in which materials 200 are ignited/combusted utilized a combustion method as known in the art. Once ignited the gas with particulates 250 formed from materials 200 flows into bottle 300 and can inhaled by end user 1500 through bottle orifice 315. Further illustrated is that smoke adaptor 10 is fittingly inserted into top capsection310 such that seal 40 forms a gas tight seal between smoke adaptor 10 and capsection310 therein not allowing gas 250 to flow out of the device assembly 100 except through orifice 315.

Figure 7:
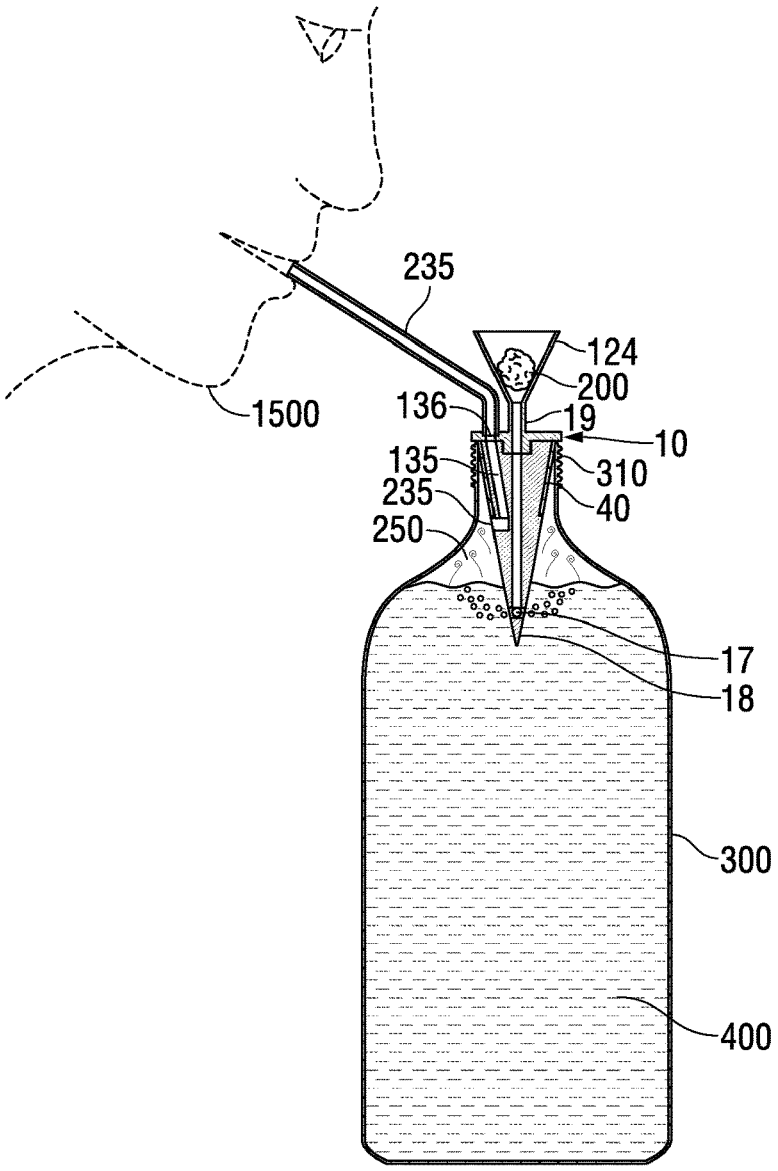
FIG. 7 is a side perspective view illustrating a bottle filled with fluid and one embodiment of the smoking adapter attached to the top of the bottle.

FIG. 7 illustrates one embodiment of the present invention utilizing a fluid 400. In many instances fluid 400 may be water, or some other noncombustible and nontoxic liquid. FIG. 7 illustrates one embodiment of the present invention smoke adaptor 10 in which materials 200 are ignited. Once ignited the gas 250 formed from materials 200 flows into bottle 300 and through the fluid 400 and can inhaled by end user 1500 (through a body orifice) through egress/intake port 235. Illustrated is that smoke adaptor 10 is fittingly inserted into top capsection310 such that seal 40 forms a gas tight seal between smoke adaptor 10 and capsection310 therein not allowing gas 250 to escape. Illustrated also is that in some embodiments of the present invention secondary shaft 135 lines up with orifice 136 when the smoking adaptor 10 is assembles such that gas 250 can flow through secondary shaft egress tube 235, through shaft 135 through orifice 136 into tube 235 and into end user 1500 when user 1500 inhales through tube 235.

While preferred embodiments have been shown and described, modifications thereof can be made by one skilled in the art without departing from the scope or teaching herein. The embodiments described herein are exemplary only and are not limiting. Many variations and modifications of the system and apparatus are possible and will become apparent to those skilled in the art once the above disclosure is fully appreciated. For example, the relative dimensions of various parts, the materials from which the various parts are made, and other parameters can be varied. Furthermore, thought the openings in the plate carriers are shown as circles, they may include other shapes such as ovals or squares. Accordingly, it is intended that the following claims be interpreted to embrace all such variations and modifications.

I claim:

1. A conical smoking adapter for smoking a substance, comprising:

a seal;

a threaded top section, threaded conical middle section and threaded metal conical lower section;

said threaded top section further comprising a receptacle with an orifice for holding combustible materials;

a first passage extending through said receptacle with an orifice for holding combustible materials;

said conical lower section further comprising plurality of radial ports disposed in said lower end; wherein said seal is configured to seal against a neck opening in a bottle; and said conical lower section further comprises a point used to pierce the surface of a bottle and said radial ports in said lower end further comprise junction and egress ports located above said point used to pierce the surface of a bottle.

2. The smoking adapter of claim 1, wherein said top section, conical middle section and conical lower sections comprise three separate modules that can mechanically engage each other in the arrangement such that the top section engages the conical middle section and the conical middle section engages the conical lower section.

3. The smoking adapter of claim 1, wherein the top section further comprises a tube attached to and in communication with a second passage running through said top section adjacent to said passage extending through said receptacle with orifice for holding combustible materials.

4. The smoking adapter of claim 3, wherein the middle section comprises a third passage running through said middle section and having an ingress port from the side of said middle section, such that said second passage and said third passage are aligned during operation to allow for passage of gas from third passage through second passage.

5. The smoking adapter of claim 1, wherein the top section further comprises a fourth passage extending through the top section and substantially perpendicular and connected to said first passage.

6. The smoking adapter of claim 1, wherein said receptacle with orifice for holding combustible materials is funnel shaped.

7. The smoking adapter of claim 4, wherein said bottle is filled with a nontoxic and noncombustible fluid.

8. A conical smoking adaptor comprising:

a central or longitudinal axis and threaded conical body having a first conical terminal section that received material;

a second metal threaded conical terminal section that forms a point used to pierce the surface of a bottle;

an annular, conical, or frustoconical seal disposed on an outer, generally cylindrical, surface of said conical body;

a top section that forms a circular face from which a cylindrical receptacle having a centrally disposed bore extending there through in which material to be combusted, or lit, may be received or disposed;

a central annulus which runs along the longitudinal access and through a second section;

a conical lower section with junction and egress ports which allow for a duct egress out of said central annulus; wherein and said egress ports are located above said point used to pierce the surface of a bottle.

9. The smoking adaptor of claim 8 further comprising:

said conical body is formed from a metal.

10. The smoking adaptor of claim 8 further comprising:

said annular, conical, or frustoconical seal has external ridges or grooves for assisting in forming a gas tight seal.

11. The smoking adaptor of claim 8 further comprising:

the smoking adaptor is molded of one solid material except for said annular, conical, or frustoconical seal which is molded of a separate elastomer material.

12. The smoking adaptor of claim 8 further comprising:

said conical middle section further comprises:

conical middle junction and middle egress ports which allow for a gas egress out of said shaft through a shaft orifice and into a tube.

13. A conical smoking adaptor comprising:

a central or longitudinal axis and a threaded metal conical body having a first terminal conical section that receives material;

a second threaded metal terminal conical section that forms a point used to pierce the surface of a bottle;

an annular, conical, or frustoconical seal disposed on an outer, generally cylindrical, surface of said conical body;

a top section that forms a circular face from which a cylindrical receptacle having a centrally disposed bore extending there through in which material to be combusted, or lit, may be received or disposed;

a central annulus which runs along the longitudinal access and through a second conical section;

a lower conical section with junction and egress ports which allow for a duct egress out of said central annulus; and said lower conical section further comprises a point used to pierce the surface of a bottle, wherein said junction and egress ports located above said point used to pierce the surface of a bottle.

* * * * *